US008152285B2

(12) United States Patent
Kim et al.

(10) Patent No.: US 8,152,285 B2
(45) Date of Patent: Apr. 10, 2012

(54) INK JET HEAD AND INK SUPPLYING METHOD THEREOF

(75) Inventors: Sung-Wook Kim, Suwon-si (KR); Seung-Joo Shin, Seoul (KR); Seok-Soon Back, Suwon-si (KR)

(73) Assignee: Samsung Electronics Co., Ltd. (KR)

( * ) Notice: Subject to any disclaimer, the term of this patent is extended or adjusted under 35 U.S.C. 154(b) by 382 days.

(21) Appl. No.: 12/497,479

(22) Filed: Jul. 2, 2009

(65) Prior Publication Data

US 2010/0182359 A1 Jul. 22, 2010

(30) Foreign Application Priority Data

Jan. 20, 2009 (KR) ..... 10-2009-0004677

(51) Int. Cl.
*B41J 29/38* (2006.01)
*B41J 2/015* (2006.01)
*B41J 2/17* (2006.01)

(52) U.S. Cl. ..... 347/84; 347/6; 347/20; 347/85; 347/86

(58) Field of Classification Search ..... 347/84–86, 347/6, 20
See application file for complete search history.

(56) References Cited

U.S. PATENT DOCUMENTS

| | | | | |
|---|---|---|---|---|
| 7,070,266 | B2 * | 7/2006 | Ogawa et al. | 347/87 |
| 7,374,273 | B2 * | 5/2008 | Miura | 347/51 |
| 2008/0238995 | A1 * | 10/2008 | Menendez et al. | 347/37 |
| 2008/0291229 | A1 * | 11/2008 | Ushiyama et al. | 347/12 |

FOREIGN PATENT DOCUMENTS

| | | | |
|---|---|---|---|
| JP | 11-240172 | | 9/1999 |
| JP | 2002-166568 | | 6/2002 |
| JP | 2003-063002 | | 3/2003 |
| JP | 2004-098300 | | 4/2004 |
| JP | 2004-224044 | | 8/2004 |
| JP | 2005-169839 | | 6/2005 |
| JP | 2005-193570 | | 7/2005 |
| JP | 2005-254679 | | 9/2005 |
| JP | 2005-342993 | | 12/2005 |
| JP | 2006-159482 | | 6/2006 |
| JP | 2007-090638 | | 4/2007 |
| JP | 2008-030333 | | 2/2008 |
| JP | 2008-162259 | | 7/2008 |
| KR | 100376204 | B | 3/2003 |
| KR | 100510123 | B | 8/2005 |
| KR | 100708195 | B1 | 4/2007 |

* cited by examiner

*Primary Examiner* — Julian Huffman
*Assistant Examiner* — Jason Uhlenhake
(74) *Attorney, Agent, or Firm* — Innovation Counsel LLP

(57) ABSTRACT

An Inkjet head according to an exemplary embodiment of the present invention includes an ink storage unit including an inner storage space, a head unit connected to the ink storage unit, and a plurality of nozzles discharging the ink, wherein the floors of the inner storage space of the ink storage unit form a step. Accordingly, in the Inkjet head of an exemplary embodiment of the present invention, the floors of the inner storage space of the ink storage unit form a step, and the ceiling of the inner flow space of the head unit is inclined, thereby preventing the ink vapor from being confined inside the head unit. Therefore, the ink to be discharged through the nozzle flows in a predetermined direction and does not include ink vapor, thereby preventing discharge deterioration.

16 Claims, 4 Drawing Sheets

INK JET HEAD AND INK SUPPLYING METHOD THEREOF

CROSS-REFERENCE TO RELATED APPLICATION

This application claims priority to and the benefit of Korean Patent Application No. 10-2009-0004677 filed in the Korean Intellectual Property Office on Jan. 20, 2009, the entire contents of which are incorporated herein by reference.

BACKGROUND OF THE INVENTION (a) Field of the Invention

The present invention relates to an Inkjet head and an ink supplying method.

(b) Description of the Related Art

Generally, various thin film patterns of flat panel displays such as a liquid crystal display (LCD) and an organic light emitting diode (OLED) display are formed through a photolithography process. A large flat panel display uses more materials during manufacturing, such as a photosensitive film that is applied on a substrate to form a thin film pattern. Moreover, much larger manufacturing equipment for a photolithography process may also be needed. This usually results in increased manufacturing costs.

In order to minimize the cost increase, an Inkjet printing system to form a thin film pattern by dripping ink has been developed. This Inkjet printing system includes an inkjet printing main body and an inkjet head having a plurality of nozzles, whereby the ink is dripped with a uniform volume through the nozzles of the inkjet head in a predetermined region on the substrate.

The Inkjet head comprises an ink storage unit and a head unit. When the ink stored in an ink storage unit of the Inkjet head is supplied to the head unit through two injection holes, most of the air is discharged through the nozzles; however, the vapor that is not discharged is confined in the flow space of the head unit. This vapor closes the flow path of the nozzles while flowing, such that abnormal discharge may be generated. Although pressure is applied to the ink to push the vapor, the pressure applied to the surface of the ink stored inside the ink storage unit acts on two injection holes with an equal magnitude, with the result that the vapor is not pushed in the predetermined direction in the flow space inside the head unit.

To remove the vapor, a structure in which the ink storage unit is connected to the head unit through only one injection hole, and an additional discharge unit is installed to the head unit, has been proposed. In this structure, the vapor may be discharged through the additional discharge unit along with the ink. However, a valve is necessary in this case, and as a controller and a device to shut off the valve are required, a large quantity of ink is consumed. Also, the injection hole is positioned on one side of the ink storage unit, such that the flow resistance is changed according to the position of the nozzle, resulting in a non-uniform discharge amount.

The above information disclosed in this Background section is only for enhancement of understanding of the background of the invention; therefore, it may contain information that does not form the prior art that is already known in this country to a person of ordinary skill in the art.

SUMMARY OF THE INVENTION

The present invention prevents the generation of vapor on the head unit of an inkjet head which is part of an inkjet printing system, in order to prevent abnormal discharge of the nozzle due to the vapor.

An Inkjet head according to an exemplary embodiment of the present invention includes an ink storage unit storing ink and including an inner storage space, and a head unit connected to the ink storage unit and including nozzles discharging the ink, wherein floors of the inner storage space of the ink storage unit form a step.

The floors of said inner storage space preferably include a lower level and an higher level that is higher than the lower level.

Said lower level and said higher level may be respectively formed with a lower injection hole and an upper injection hole connected to the head unit.

The inkjet head according to another embodiment of the present invention may include a head unit comprising an inner flow space connecting a lower injection hole to an upper injection hole, such that the lower injection hole and the upper injection hole are formed in an asymmetric arrangement in the inner flow space.

The head unit in the inkjet head according to an exemplary embodiment of the present invention may include an inner flow space where the ink flows, a lower connection hole and an upper connection hole, respectively connecting the lower injection hole and the upper injection hole, may be formed on the ceiling of the inner flow space, and the ceiling of the inner flow space may be inclined.

The height of the entrance of the lower connection hole toward the inner flow space may be lower than that of the entrance of the upper connection hole.

The ceiling of the inner flow space may be inclined from the entrance of the lower connection hole to the entrance of the upper connection hole.

An ink supplying hole, formed at the sidewall of the inner storage space of the ink storage unit, may be further included, according to an exemplary embodiment of the present invention, wherein the ink supplying hole may be disposed near the lower level and may supply the ink to the ink storage unit through the ink supplying hole.

In yet another embodiment of the present invention, a pressure controller formed in the ink storage unit may be used to control the size and shape of the meniscus formed by the ink droplet at the tip of the nozzles, pushing the ink stored in the ink storage unit.

In another embodiment of the present invention, an ink supplying method of an Inkjet head is provided, including an ink storage unit having an inner storage space, storing ink, a head unit connected to the ink storage unit and having nozzles discharging the ink, and wherein floors of the inner storage space include a lower level and an higher level that is higher than the lower level. The lower level and higher level are respectively formed with a lower injection hole and an upper injection hole connected to the head unit. Said ink supplying method, according to an exemplary embodiment of the present invention, consists essentially of: firstly supplying the ink at the lower level of the ink storage unit; stopping the first supply of the ink while the ink does not flow out through the upper injection hole formed at the higher level and the water level of the ink reaches the higher level of the ink storage unit; stopping the first supply of the ink when the water level of the ink is lower than the higher level of the ink storage unit; secondly supplying the ink at the ink storage unit when the ink flows out to the higher level of the ink storage unit and the flowing ink meets the ink filled at the lower level of the ink storage unit; and stopping the second supply of the ink when the ink arrives at a target water level.

The ink flowing to the head unit through the lower injection hole formed at the lower level may flow out through the upper injection hole formed at the higher level.

The ink flowing into the inner flow space of the head unit through the lower injection hole in the first supplying step may flow out through the upper injection hole according to an inclined ceiling formed in the inner flow space in a predetermined direction.

The ink may flow into the inner flow space of the head unit through both the lower injection hole and the injection hole in the second supplying step.

According to an exemplary embodiment of the present invention, the floors of the inner storage space of the ink storage unit have a step such that the ceiling of the inner flow space of the head unit is inclined, thereby preventing the vapor from being confined by the head unit. Accordingly, the ink including the vapor is not discharged through the nozzle, thereby preventing the discharge deterioration. Furthermore, the lower injection hole and the upper injection hole are formed asymmetrically in the structure, so that the ink flows in a predetermined direction.

Also, when supplying the ink, a discharge unit guiding the ink in a predetermined direction and a valve controlling the discharge unit to remove the vapor are not required such that the structure is simple, and a driving unit and a controller for shutting off the valve are not necessary, thereby being economical.

Also, when supplying the ink, a non-uniformity of the discharge amount according to the position of the nozzles, which may be easily generated in the structure where the injection holes are formed asymmetrically for the ink to flow in a predetermined direction, may be prevented, as will be shown further below.

According to another exemplary embodiment of the present invention, an inkjet printing system to form a thin film pattern on a substrate is provided. Said inkjet printing system comprising an inkjet head having an ink storage unit that includes an inner storage space, storing ink, a head unit having an inner flow space connected to the ink storage unit, and nozzles to discharge the ink. The inner storage space having a floor that includes a step, and the inner flow space having a ceiling that is inclined. Further, the inkjet printing system may comprise a transfer unit and a supplying unit.

In another embodiment of the present invention, the inkjet printing system is provided with a transfer unit comprising a support for positioning said inkjet head above said substrate by a predetermined distance, a horizontal transfer part for transferring said inkjet head across the substrate in two directions, essentially orthogonal to one another; and a lifter, for lifting said inkjet head above the substrate by a predetermined distance.

In another embodiment of the present invention, the inkjet printing system is provided with a supplying unit further comprising a plurality of ink tanks storing ink, and a supplying pipe for supplying ink from said ink tanks to said inkjet head.

According to another embodiment of the present invention, the inkjet printing system is provided with a plurality of ink tanks comprising at least a red ink tank, a blue ink tank, and a green ink tank.

In yet another embodiment of the present invention, a method of using an inkjet printing system to form a color filter on a substrate is provided. Said inkjet printing system comprises an inkjet head and an ink storage unit having an inner storage space, storing ink, and a head unit connected to the ink storage unit. Said head unit further including nozzles discharging the ink. Further, a floor of the inner storage space includes a step, and the ceiling of the inner flow space is inclined. Said inkjet printing system comprising a transfer unit and a supplying unit to supply ink to said inkjet head. Further, said substrate comprising light blocking members formed on the substrate. Forming said color filter on said substrate consists of transferring said inkjet head across the substrate using the transfer unit, and dripping the ink from the inkjet head on a predetermined position between light blocking members on the substrate.

DETAILED DESCRIPTION OF THE EMBODIMENTS

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

Figure 1:
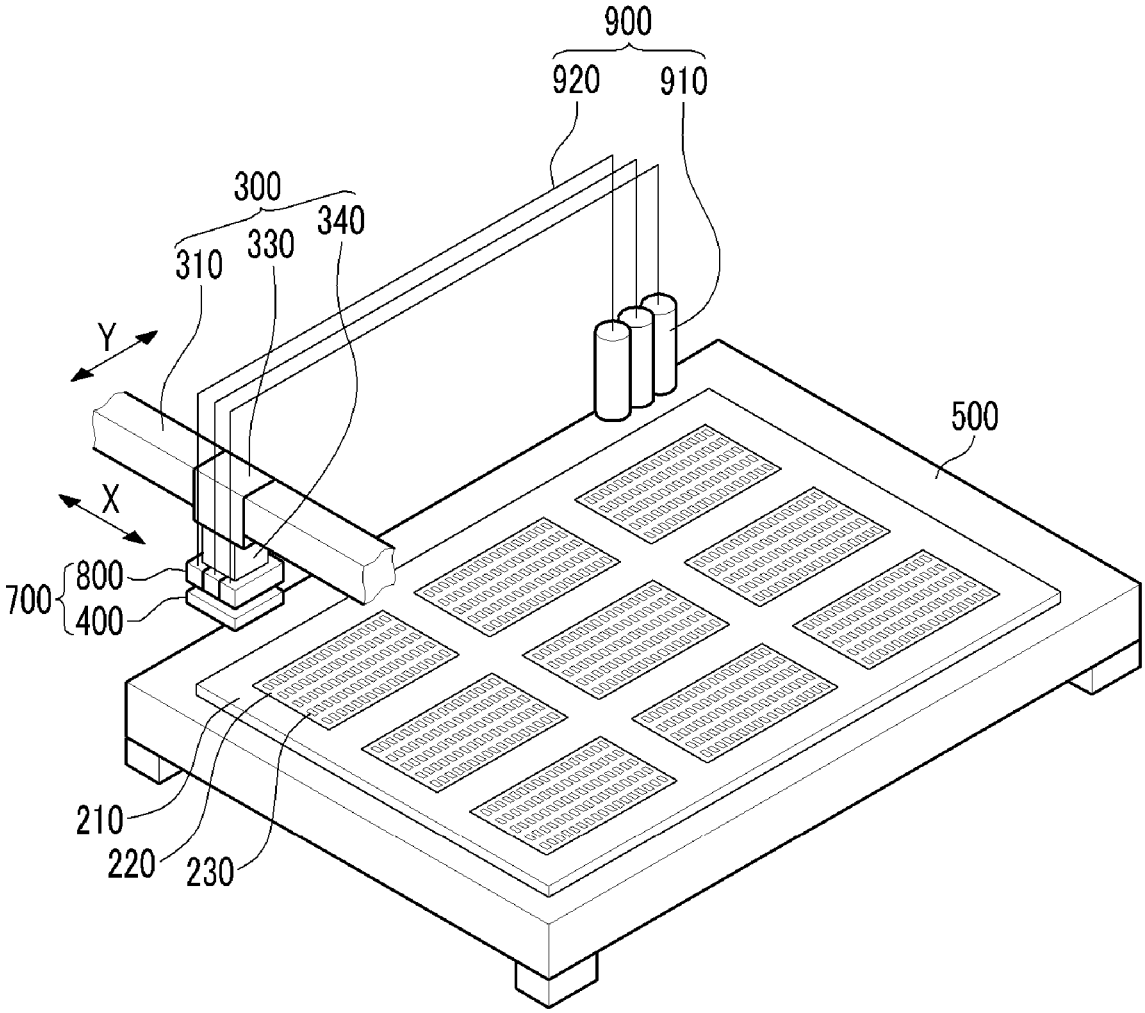
FIG. 1 is a perspective view of an inkjet printing system including an Inkjet head according to an exemplary embodiment of the present invention.
Figure 2:
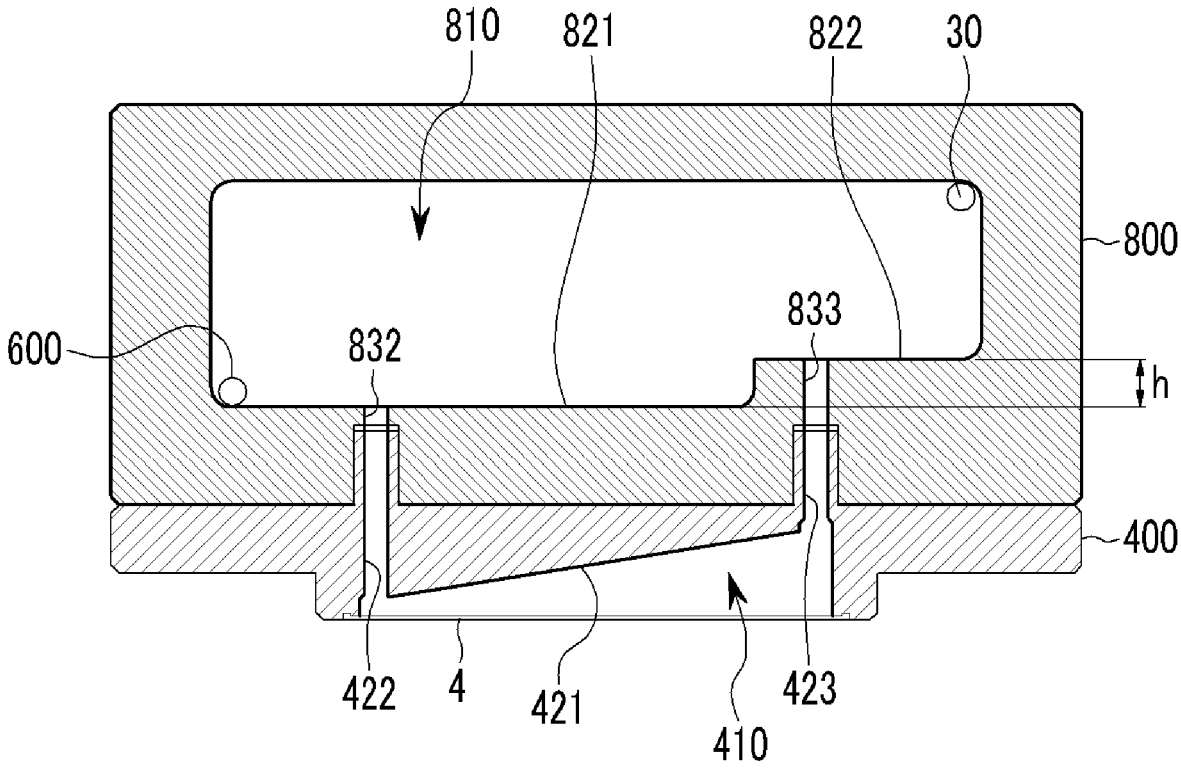
FIG. 2 is a cross-sectional view of the Inkjet head shown in FIG. 1.

FIG. 1 is a perspective view of an inkjet printing system including an Inkjet head according to an exemplary embodiment of the present invention, and FIG. 2 is a cross-sectional view of the Inkjet head shown in FIG. 1.

As shown in FIG. 1, an inkjet printing system including an Inkjet head according to an exemplary embodiment of the present invention includes an Inkjet head 700 dripping ink 231 (see FIG. 4) on a substrate 210, a transfer unit 300 transferring the Inkjet head 700, and a supplying unit 900 supplying the ink 231 to the Inkjet head 700.

The Inkjet head 700 is disposed and spaced apart from a stage 500 on which the substrate 210 is mounted by a predetermined distance. A plurality of Inkjet heads 700 may be included, and may include inkjet heads for different-colored ink (e.g. a red ink Inkjet head, a green ink Inkjet head, and a blue ink Inkjet head).

The Inkjet head 700 includes an ink storage unit 800 having an inner storage space where the ink 231 is stored, and a head unit 400 connected to the ink storage unit 800 and including a plurality of nozzles 4 discharging the ink 231.

The transfer unit 300 includes a support 310 for positioning the Inkjet head 700 a predetermined distance above the substrate 210, a horizontal transfer part 330 for transferring the head unit 700 in the X or Y direction, and a lifter 340 for lifting the Inkjet head 700.

The supplying unit 900 includes a plurality of ink tanks 910 storing the ink 231, and a supplying pipe 920 supplying the ink 231 from the ink tanks 910 to the ink storage unit 800. It is preferable that the plurality of ink tanks 910 include red, green, and blue ink tanks.

To form a color filter 230 on the substrate 210 on the stage 500, the Inkjet head 700 is transferred in the X direction through the transfer unit 300 and the ink 231 is dripped through the nozzles 4 of the Inkjet head 700. The ink 231 is dripped on a predetermined position thereby forming the color filter 230 between light blocking members 220 on the substrate 210.

Next, the structure of the Inkjet head will be described in detail with reference to FIG. 2.

As shown in FIG. 2, floors 821 and 822 of the inner storage space 810 of the ink storage unit 800 comprise a step. That is, the floor of the ink storage unit 800 includes a lower level 821 and an upper level 822 that is higher than the lower level 821 by a predetermined height h. Accordingly, the ink 231 supplied to the ink storage unit 800 first fills the lower level 821.

An ink supplying hole 600 is formed on the side wall of the inner storage space 810 of the ink storage unit 800, and the ink 231 transferred from the ink tank 910 through the supplying pipe 920 is stored in the ink storage unit 800 through the ink supplying hole 600. To prevent the ink 231 from being supplied to the higher level 822 at the initial stage of the ink supplying method disclosed herein, the ink supplying hole 600 is disposed close to the lower level 821.

A pressure controller 30 is formed on the ink storage unit 800 thereby controlling the size and shape of the meniscus formed by the ink droplet at the tip of the nozzles 4, and pushing the ink stored in the ink storage unit 800.

A lower injection hole 832 and an upper injection hole 833 that are connected to the head unit 400 are respectively formed at the lower level 821 and the higher level 822 of the ink storage unit 800. The ink 231 filled in the ink storage unit 800 through the lower injection hole 832 and the upper injection hole 833 is transferred to the head unit 400.

The head unit 400 has an inner flow space 410, and a lower connection hole 422 and an upper connection hole 423 connecting the inner flow space 410 to the ink storage unit 800. Said lower connection hole and upper connection hole are formed at the ceiling 421 of the inner flow space 410. A plurality of nozzles 4, discharging the ink 231, is formed on the bottom of the inner flow space 410.

The lower surface of the ink storage unit 800 contacts the upper surface of the head unit 400, and the lower injection hole 832 and the upper injection hole 833 of the ink storage unit 800 are respectively connected to the lower connection hole 422 and the upper connection hole 423 of the head unit 400.

The ceiling 421 of the inner flow space 410 is inclined, and the height of the entrance of the lower connection hole 422 toward the inner flow space 410 is lower than the height of the entrance of the upper connection hole 423 toward the inner flow space 410. That is, the ceiling 421 of the inner flow space 410 is inclined from the entrance of the lower connection hole 422 to the entrance of the upper connection hole 423. Accordingly, the ink supplied to the inner flow space 410 through the lower connection hole 422 may flow out through the upper connection hole 423 and the upper injection hole 833 formed at the higher level 822 of the ink storage unit 800 according to the inclined ceiling 421. Like this, the lower injection hole 832 and the upper injection hole 833 are formed asymmetrically in the structure, so that the ink flows in a predetermined direction. Thus, the ink flowing in the predetermined direction flows such that vapor generated at the flow space 410 of the head unit 400 may be easily removed in the inner flow space 410.

Also, when supplying the ink, the discharge unit guiding the ink 231 in the predetermined direction and the valve controlling the discharge unit to remove the vapor are not required, and the driving unit and the controller for the shutoff of the valve are not necessary. Thus, the resulting inkjet head structure is simple and economical.

Also, when supplying the ink, a non-uniformity of the discharge amount according to the position of the nozzles 4, which may be easily generated in the structure where the injection holes are formed asymmetrically for the ink to flow in a predetermined direction, may be prevented, as will be shown further below.

The ink 231 supplied to the inner flow space 410 is distributed to the nozzles 4, and discharged outside.

Next, an ink supplying method using an Inkjet head according to an exemplary embodiment of the present invention will be described in detail.

Figure 3:
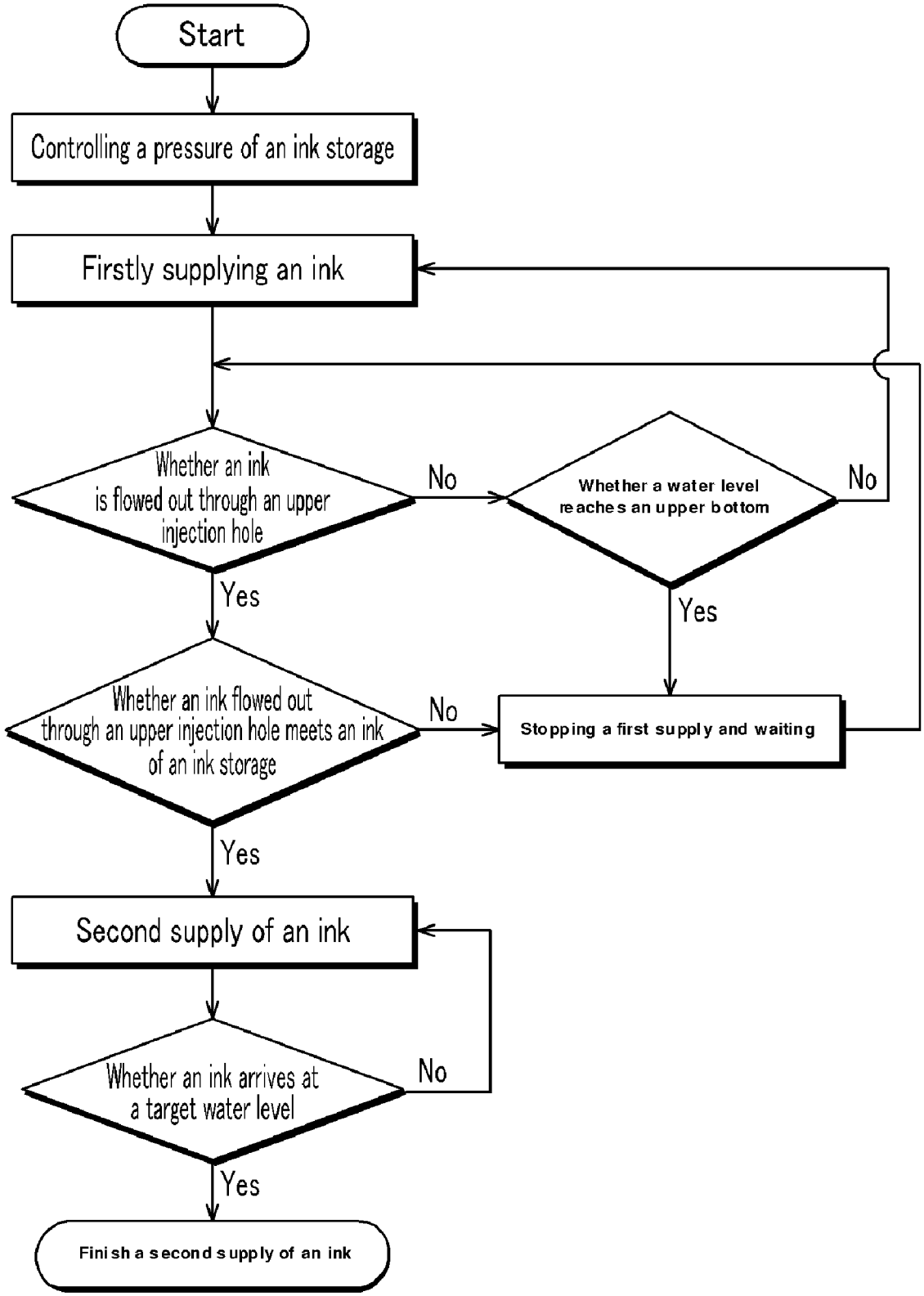
FIG. 3 is a flowchart of an ink supplying method of an Inkjet head according to an exemplary embodiment of the present invention.
Figure 4:
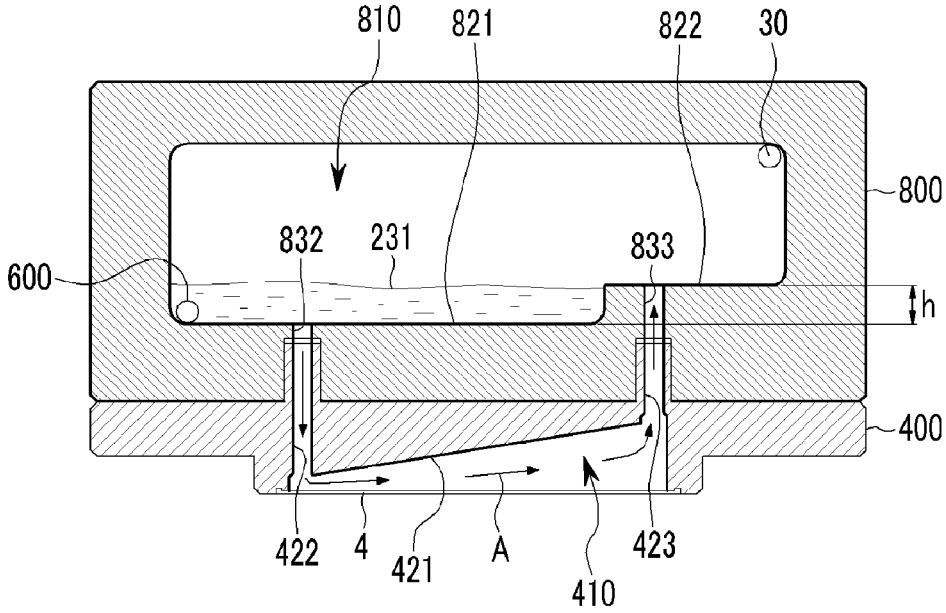
FIG. 4 is a cross-sectional view for an ink supplying method of an Inkjet head according to an exemplary embodiment of the present invention, and showing the first supplying step.
Figure 5:
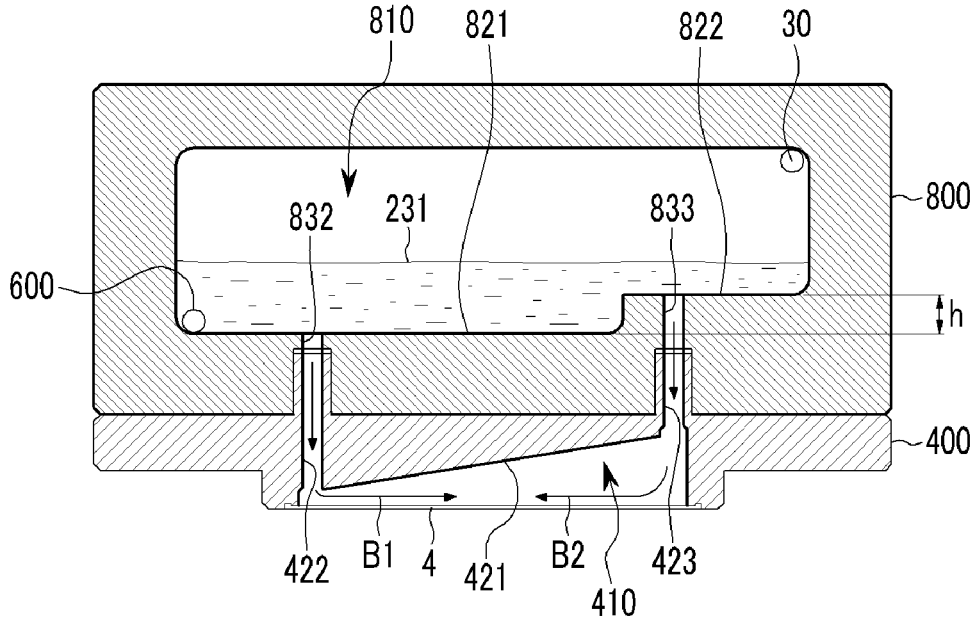
FIG. 5 is a cross-sectional view for an ink supplying method of an Inkjet head according to an exemplary embodiment of the present invention, and showing the second supplying step.

FIG. 3 is a flowchart of an ink supplying method of an Inkjet head according to an exemplary embodiment of the present invention, FIG. 4 is a cross-sectional view for an ink supplying method of an Inkjet head according to an exemplary embodiment of the present invention and showing the first supplying step, and FIG. 5 is a cross-sectional view for an ink supplying method of an Inkjet head according to an exemplary embodiment of the present invention and showing the second supplying step.

First, as shown in FIG. 3 and FIG. 4, pressure of the inner storage space 810 of the ink storage unit 800 is controlled to be atmospheric pressure by using the pressure controller 30.

A first supply of the ink 231 is provided at the lower level 821 of the ink storage unit 800. When the first supply of the ink 231 is provided, the ink 231 flows to the inner flow space 410 of the head unit 400 through the lower injection hole 832 formed at the lower level 821 and the lower connection hole 422 of the head unit 400. Here, the ink 231 does not flow into the inner flow space 410 of the head unit 400 through the upper injection hole 833 formed at the higher level 822 and the upper connection hole 423 of the head unit 400 thereby preventing the vapor from being trapped in the inner flow space 410.

Next, the ink, having flowed in to the inner flow space 410 through the lower connection hole 422 of the head unit 400, fills the inner flow space 410 conforming to the inclined ceiling 421 of the inner flow space 410. Eventually, the inner flow space 410 fills up, the ink level rises into the upper connection hole 423, and flows into the inner storage space 810 through the upper injection hole 833 as shown by the arrows in FIG. 4. The ink flows out to the higher level 822 through the upper connection hole 423 and the upper injection hole 833 of the head unit 400. Here, the vapor that was in the inner flow space 410 is pushed out of the inner flow space 410 by the ink 231 that flows in the predetermined direction A, eventually being released in to the ink storage unit 800. Thus, the configuration of FIG. 4 eliminates vapor/gas from the inner flow space 410.

Next, it is verified whether or not the ink 231 has flowed into the inner storage space 810 through the upper injection hole 833 formed at the higher level 822. Here, when the ink 231 has not flowed into the inner storage space 810 through the upper injection hole 833 formed at the higher level 822 and when the water level of the ink 231 reaches the higher level 822 of the floor of the ink storage unit 800, the first supply of the ink 231 is stopped. This is because the ink 231 may flow into the inner flow space 410 of the head unit 400 through the upper injection hole 833 formed at the higher level 822 and the upper connection hole 423 of the head unit 400 when the water level of the ink 231 reaches the higher level 822 of the ink storage unit 800, and vapor may be generated in the inner flow space 410. This undesired effect may be the result if the ink 231 is allowed to flow into the inner flow space 410 of the head unit 400 through the upper injection hole 833 formed at the higher level 822.

However, when the ink 231 does not flow into the ink storage space 810 through the upper injection hole 833 in the higher level 822, and the water level of the ink 231 in the inner storage space 810 is lower than the height of the higher level 822 of the ink storage unit 800, the first supply of the ink 231 continues.

Once the inner flow space 410 has been filled with ink by repeating the first supply step, as shown in FIG. 4 and FIG. 5, the ink 231 flows into the inner storage space 810 through the upper injection hole 833 formed at the higher level 822 of the ink storage unit 800. Then, the ink 231 that enters the inner storage space 810 through the upper injection hole 833 meets the ink 231 in the lower level 821 of the ink storage unit 800, and a second supply of the ink 231 is provided at the ink storage unit 800 through the ink supplying hole 600. The second supply of the ink is stopped once the ink reaches a target water level. Here, the inner flow space 410 and the lower level 821 of the inner storage space 810 are filled with the ink 231 such that vapor is not present in the inner flow space 410.

After the second supply of ink is triggered, even if the ink 231 were to enter the inner flow space 410 of the head unit 400 through the upper injection hole 833 formed at the higher level 822 and the upper connection hole 423 of the head unit 400, vapor would not be generated. Also, as the level of the ink 231 over the lower level 821 and the higher level 822 is even, the ink 231 is supplied to the head unit 400 in the B1 direction through the lower injection hole 832 and the lower connection hole 422, and simultaneously the ink 231 is supplied to the head unit 400 in the B2 direction through the upper injection hole 833 and the upper connection hole 423. In this case, the pressure by the ink 231 applied to the nozzles 4 is substantially the same, regardless of the position of the nozzles 4. Thus, the non-uniformity of the discharge amount according to the positions of the nozzles 4 is prevented.

Next, when the ink 231 arrives at a target level, the second supply of the ink 231 is stopped.

To avoid trapping vapor or gas in the inner flow space 410, the invention controls the ink supply through the supply hole 600 to ensure that the inner flow space 410, the upper connection hole 423, and the upper injection hole 833 are filled before letting the ink level in the inner storage space 810 rise higher than the higher level 822 of the floor.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. An inkjet head comprising:

an ink storage unit comprising an inner storage space storing ink; and a head unit connected to the ink storage unit and including nozzles for discharging the ink, wherein a floor of the inner storage space of the ink storage unit includes a lower level and a higher level that is higher than the lower level, the lower level and the higher level respectively comprising a lower injection hole and an upper injection hole connected to the head unit.

2. The inkjet head of claim 1, wherein the head unit comprises an inner flow space connecting the lower injection hole to the upper injection hole, and wherein the lower injection hole and the upper injection hole are formed in an asymmetric arrangement in the inner flow space.

3. The inkjet head of claim 1, wherein the head unit comprises an inner flow space where the ink flows, and a lower connection hole and an upper connection hole respectively connected to the lower injection hole and the upper injection hole are formed on the ceiling of the inner flow space.

4. The inkjet head of claim 3, wherein the lower connection hole is closer to a bottom of the inner flow space than the upper connection hole.

5. The inkjet head of claim 4, wherein the ceiling of the inner flow space is inclined.

6. The inkjet head of claim 5, further comprising an ink supplying hole formed at a sidewall of the inner storage space of the ink storage unit, wherein the ink supplying hole is disposed near the lower level of the floor and supplies the ink to the ink storage unit through the ink supplying hole.

7. The inkjet head of claim 6, further comprising a pressure controller formed on said ink storage unit controlling the size and shape of the meniscus formed by the ink droplet at the tip of the nozzles, and pushing said ink stored in said ink storage unit.

8. An ink supplying method of an inkjet head including an ink storage unit having an inner storage space storing ink, a head unit having an inner flow space connected to the ink storage unit and having nozzles for discharging the ink, a floor of the inner storage space including a lower level and a higher level that is higher than the lower level, and the lower level and higher level are respectively formed with a lower injection hole and an upper injection hole connected to the head unit, comprising:

providing a first supply of the ink at the lower level of the ink storage unit;

controlling the first supply of the ink such that the level of the ink is no higher than the higher level of the ink storage unit, thus preventing the ink from flowing into the inner storage space through the upper injection hole formed at the higher level;

repeating said first supply of the ink until said inner flow space in said head unit and said lower level of said inner storage space are filled with ink; and providing a second supply of the ink at the ink storage unit when the ink flows into the ink storage unit through the upper injection hole and the flowing ink meets the ink filling the lower level of the ink storage unit.

9. The ink supplying method of claim 8, wherein the ink flowing into the head unit through the lower injection hole formed at the lower level flows out of the head unit through the upper injection hole formed at the higher level.

10. The ink supplying method of claim 9, wherein the ink flowing into the inner flow space of the head unit through the lower injection hole in the first supply flows out through the upper injection hole according to the inclined ceiling of the inner flow space in one direction.

11. The ink supplying method of claim 10, wherein the ink flows into the inner flow space of the head unit through both the lower injection hole and the upper injection hole in the second supply.

12. An inkjet printing system to form a thin film pattern on a substrate comprising:

an inkjet head comprising an ink storage unit including an inner storage space storing ink, the inkjet head further comprising a head unit, the head unit having an inner flow space connected to the ink storage unit and including nozzles for discharging the ink, wherein a floor of the inner storage space includes a lower level and a higher level that is higher than the lower level, the lower level and the higher level respectively comprising a lower injection hole and an upper injection hole connected to the head unit, and further wherein the ceiling of said inner flow space is inclined;

a transfer unit; and a supplying unit.

13. The inkjet printing system of claim 12, wherein said transfer unit comprises:

a support for positioning said inkjet head above said substrate by a predetermined distance;

a horizontal transfer part for transferring said inkjet head across the substrate in two directions essentially orthogonal to one another; and a lifter for lifting said inkjet head above the substrate.

14. The inkjet printing system of claim 12, wherein said supplying unit comprises:

a plurality of ink tanks storing ink; and a supplying pipe for supplying ink from said ink tanks to said inkjet head.

15. The inkjet printing system of claim 14 wherein said plurality of ink tanks comprises at least a red ink tank, a blue ink tank, and a green ink tank.

16. A method for forming a color filter on a substrate, the method comprising:

using an inkjet printing system, said inkjet printing system comprising:

an inkjet head comprising an ink storage unit including an inner storage space storing ink, a head unit connected to the ink storage unit and including nozzles for discharging the ink, wherein a floor of the inner storage space includes a lower level and a higher level that is higher than the lower level, the lower level and the higher level respectively comprising a lower injection hole and an upper injection hole connected to the head unit, and further wherein the ceiling of said inner flow space is inclined;

a transfer unit; and a supplying unit to supply said ink to said inkjet head;

transferring said inkjet head across said substrate using said transfer unit; and dripping said ink from said inkjet head on a predetermined position between light blocking members on the substrate.

* * * * *